United States Patent [19]

Liaw

[11] Patent Number: 4,789,133

[45] Date of Patent: Dec. 6, 1988

[54] COMPACT LIFTING ASSEMBLY

[76] Inventor: Huey-sen Liaw, 52, Lane 96, Dung-shin Road, Da Li Hsiang, Taiwan

[21] Appl. No.: 58,921

[22] Filed: Jun. 5, 1987

[51] Int. Cl.[4] ..... B66F 3/18

[52] U.S. Cl. ..... 254/103

[58] Field of Search ..... 254/DIG. 2, 98, 103, 254/425, 424; 200/47, 300, 331, 336

[56] References Cited

U.S. PATENT DOCUMENTS

| | | | |
|---|---|---|---|
| 2,979,909 | 4/1961 | Broadbent | 254/103 |
| 3,502,301 | 3/1970 | Davis et al. | 200/47 |
| 3,768,088 | 10/1973 | Risius | 254/424 |
| 3,888,464 | 6/1975 | Felsen | 254/425 |

*Primary Examiner*—Robert C. Watson

*Attorney, Agent, or Firm*—Connolly & Hutz

[57] ABSTRACT

Small sized lifting apparatus which can adjust the lifting rod up or down to an expected point automatically.

2 Claims, 3 Drawing Sheets

COMPACT LIFTING ASSEMBLY

BACKGROUND OF THE INVENTION

Small-sized motor-actuated lifting apparatus generally used have shortcomings because of their own structure. First, the lift rod is threadedly engaged with a vertical screw or bolt in a simple way so that the operator has to pay close attention to the height the lift rod has gone to, lest the lift rod go beyond the top of the screw and unthreads itself. Then, when lowering the lift rod, the operator has to watch it carefully for fear that the lift rod goes down against a bottom stop and damages the motor. Such kind of structure is obviously faulty because it causes a lot of inconvenience to the operator as well as possible damage to the motor.

Something has been done by those who tried to improve the lifting apparatus. They designed a bolt with screw thread in the middle only, both ends of the bolt having smooth shanks. In this way, as they hoped, the lift rod will not go too far up or down. That is, the lift rod no longer separates itself from the bolt, nor does it press against a bottom so tightly as to cause damage to the motor. However, the bolt of this kind has its own faults too. For example, when the lift rod is raised to the top or lowered to the bottom and is to be reversed, an external force is needed to push or pull it back to the place where its internal thread can threadedly re-engage the thread of the bolt. It is inconvenient for the operator to handle this.

Moreover, when the two types of lifting apparatus—the traditional one and the partly modified one as mentioned above are repeatedly used to jack things up for the same distance, the operator has always to keep an eye on the distance from low to high so as to cut the electricity to the motor at the right time. Of course it is very inconvenient to do so.

SUMMARY OF THE INVENTION

The present invention relates to an improvement in small size lifting apparatus. The lift rod automatically stops at any expected point when it is moving up or down.

A horizontal worm is meshed to the lower part of the vertical screw, and there are two specially designed "pushing bars" at one end of the horizontal worm to actuate a microswitch and stop the lift rod movement. In this way the lift rod could be prevented from moving beyond the upper end of the screw, and be prevented from pressing against the bottom stop. The distance between the two "pushing bars" could be adjusted to control the lift rod's moving up or down to any expected point. It is obvious that such lifting apparatus is more practical than traditional ones.

DESCRIPTION OF THE PREFERRED EMBODIMENT

Figure 1:
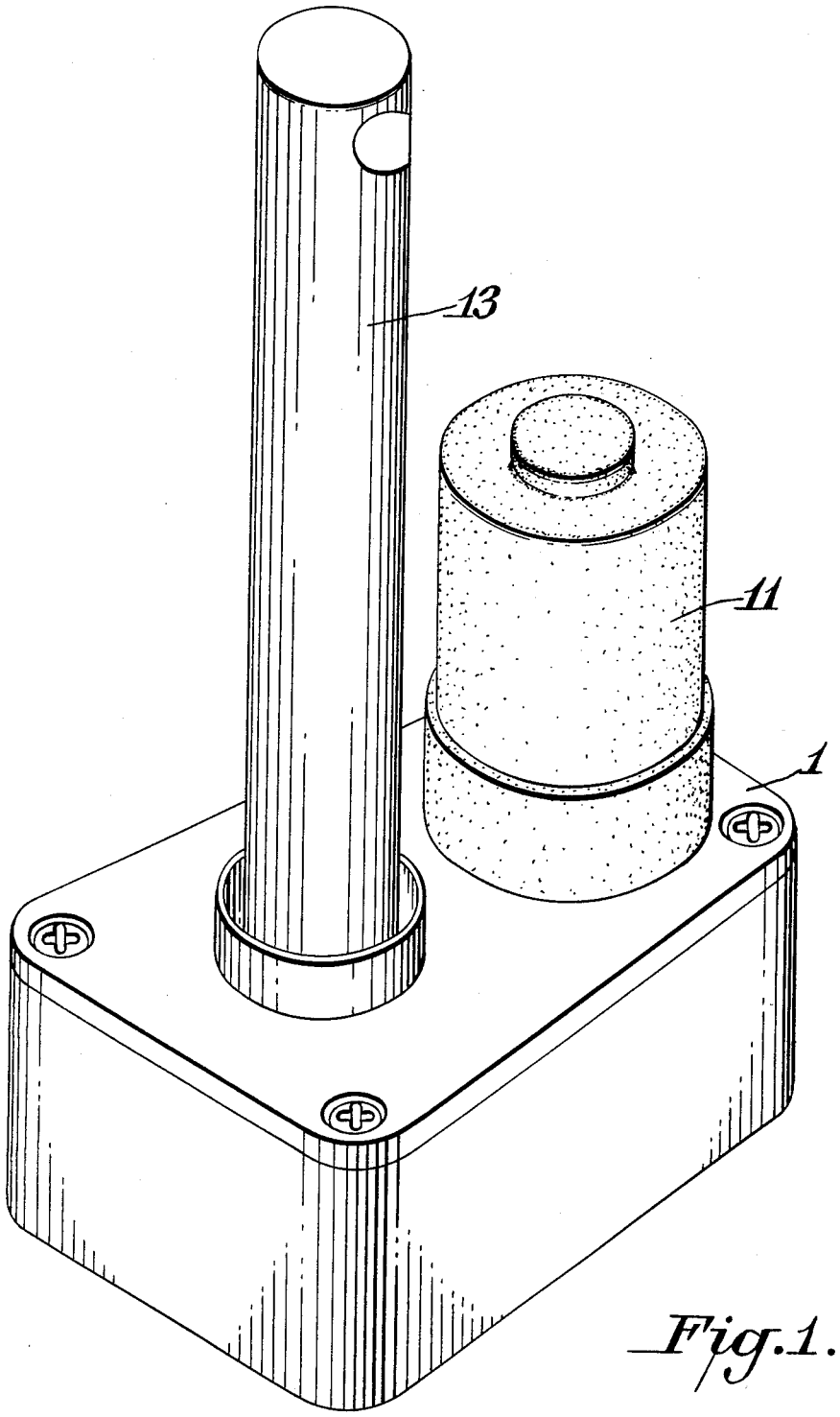
FIG. 1 is a perspective view of this invention.
Figure 2:
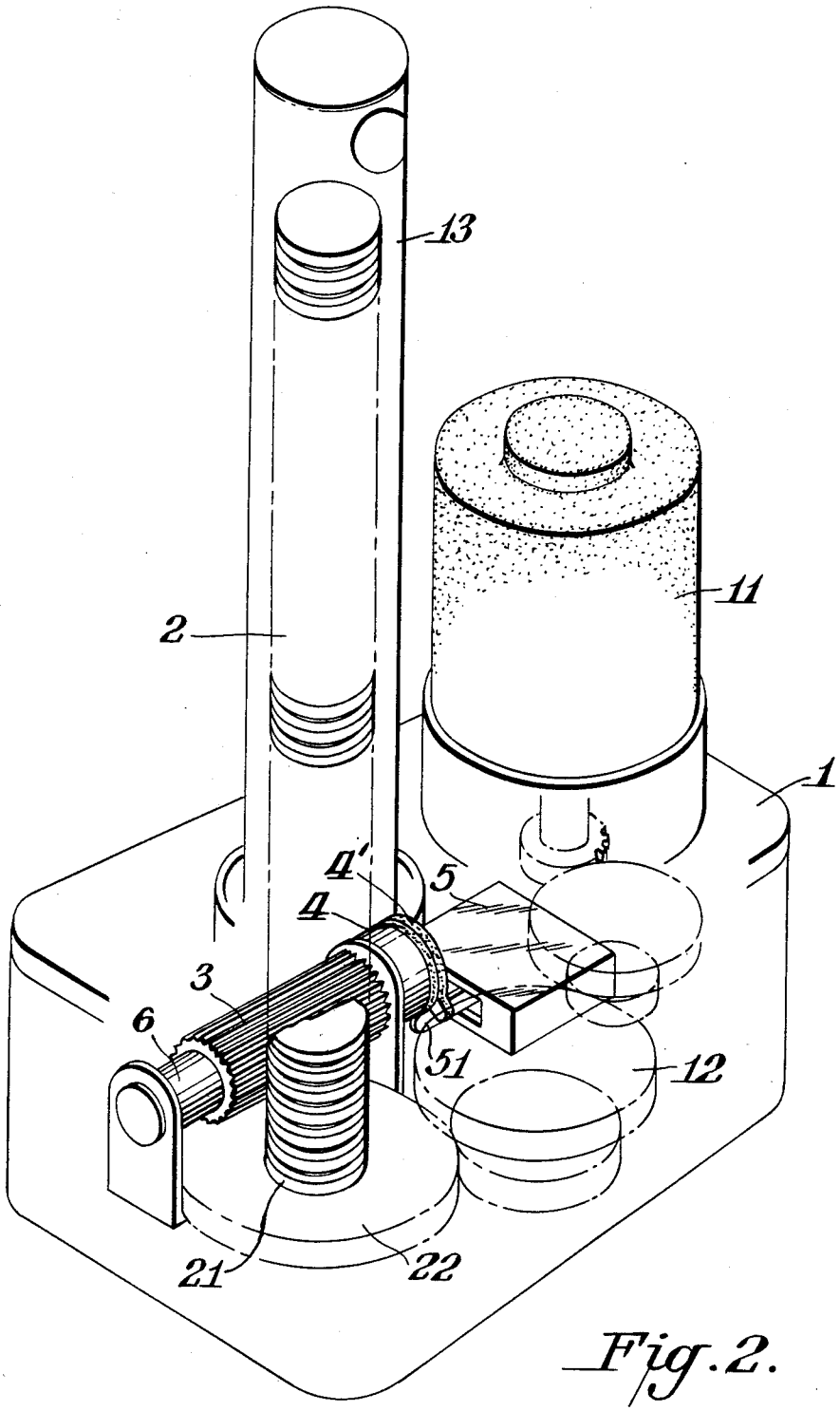
FIG. 2 is a view similar to FIG. 1 but broken away to show its interior.
Figure 3:
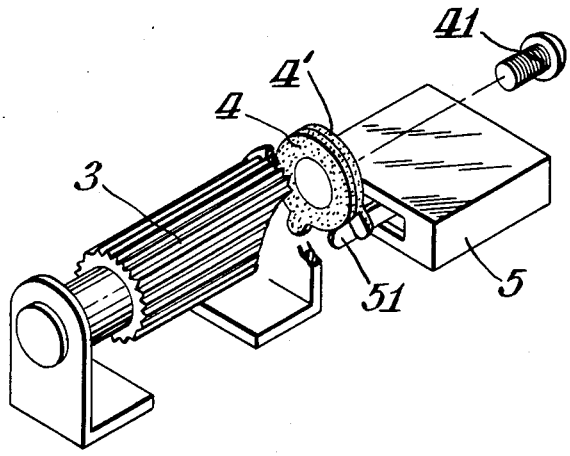
FIGS. 3 and 4 are detail views of part of the interior.
Figure 4:
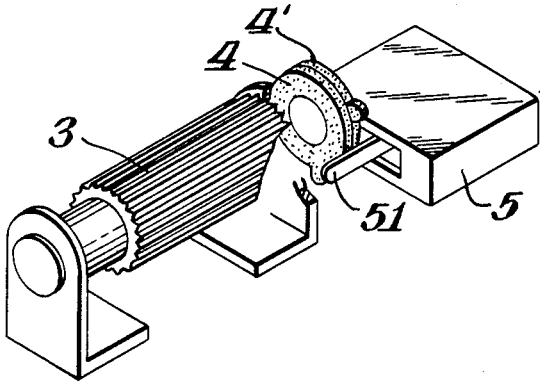

As shown, the structure of this invention is mainly composed of a spiral thread around the screw shaft 2 on journalled in the base 1, which thread transmits movements to a horizontal worm 3 carried by a horizontal worm shaft 6. At one end of the worm shaft two pushing cams 4,4' are fixed by screw 41, and in the appropriate place in the base 1 is a double-acting microswitch 5. The spring arm 51 of the switch sticks out between the cam lobes of the two pushing cams. These are the chief components. The functions of these components are described as follows:

When the motor 11 on the base 1 is turning in normal direction, the movement which is transmitted through the reduction gearing 12 to the gear 22 at the bottom of the screw shaft 2, makes the screw shaft 2 turn and therefore makes the threaded-on lift rod 13 go up. At the same time, the screw thread 21 around the lower part of the screw shaft makes the horizontal worm 3 turn. This causes the pushing cams 4,4' to turn as well. Then the pushing cams move to some distance, which can be adjusted in accordance with the operator's needs, one of the pushing cams will touch and give a push to the spring arm of the microswitch. As a result, the electrical current is cut, both the motor and the screw shaft 2 stop turning, and the lift rod 13 stops moving up too.

To make the lift rod 13 move down, the operator can make the motor 11 turn in the opposite direction by means of a control switch. When the lift rod 13 moves down to some expected distance, the cam lobe on the other pushing cam at the end of the horizontal screw shaft will push the spring arm 51 of the double-acting microswitch 5, so that the electrical current is again cut. Both the motor 11 and the screw shaft 2 therefore again stop turning, and also the lift rod 13 stops automatically.

If the operator wants to control the distance that the lift rod goes up or down, he only need to unfasten the screw 41 at the end of the horizontal worm 3 and then modify or reset the distance between the two pushing cam 4,4', and finally fasten the screw again. Adjusting the distance is quite simple.

To sum up, this invention is aimed at the structural improvement of the traditional small-sized lifting apparatus. This makes it possible that the lift rod stops moving up or down automatically, and the moving distance can be easily adjusted by the operator. The lift rod, therefore, will not drop away, and the motor will not be damaged because the lift rod goes too far down. This type of small-sized lifting apparatus is much more practical.

I claim:

1. A compact lifting and lowering assembly having a compact housing to which is secured an electric motor and from which a lift screw projects in one direction, a drive mechanism within the housing connected between the motor and the lift screw to cause the motor to controllably rotate the lift screw in either direction, a worm gear mounted within the housing and directly meshed with the adjacent end of the lift screw so that rotation of the lift screw causes much slower rotation of the worm gear, and limit means within the housing connected for actuation by the worm gear to stop the lift screw rotation when the worm gear rotation reaches a limit.

2. The combination of claim 1 in which the motor projects from the housing alongside and in the same direction as the lift screw, and the motor does not project as far out as the lift screw does.

* * * * *